US005794696A

United States Patent [19]

Gibson et al.

[11] Patent Number: 5,794,696

[45] Date of Patent: Aug. 18, 1998

[54] GROUNDWATER TESTING WELL

[75] Inventors: Thomas Loughborough Gibson, Utica; Paul David Chalmer, Chelsea; Abdul Shaheed Abdul, Troy, all of Mich.

[73] Assignee: National Center for Manufacturing Sciences, Ann Arbor, Mich.

[21] Appl. No.: 720,940

[22] Filed: Oct. 4, 1996

[51] Int. Cl.[6] ..... E21B 49/08

[52] U.S. Cl. ..... 166/264; 73/152.28; 166/191; 166/313; 175/20; 175/59

[58] Field of Search ..... 166/264, 313, 166/191; 175/20, 59; 73/152.25, 152.23, 152.24, 152.26, 152.28

[56] References Cited

U.S. PATENT DOCUMENTS

| | | | |
|---|---|---|---|
| 2,210,546 | 8/1940 | Hassler | 166/264 |
| 2,564,198 | 8/1951 | Elkins | 166/264 |
| 2,781,663 | 2/1957 | Maly et al. | 73/152.26 |
| 4,538,683 | 9/1985 | Chulick | 166/264 |
| 4,745,801 | 5/1988 | Luzier | 166/264 |
| 5,293,931 | 3/1994 | Nichols et al. | 166/264 X |
| 5,358,057 | 10/1994 | Peters et al. | 175/20 |

FOREIGN PATENT DOCUMENTS

| | | | |
|---|---|---|---|
| 217033 | 1/1985 | Germany | 73/152.23 |

*Primary Examiner*—Hoang C. Dang
*Attorney, Agent, or Firm*—Thomas S. Baker, Jr.

[57] ABSTRACT

An earth contamination site groundwater testing well having a borehole which passes though subsurface soil zones of interest is provided with a probe assembly that is installed in the borehole, that has a core stem which carries spaced-apart flexible disc seals that divide the borehole into different borehole zones that correspond to the subsurface soil zones of interest, and that includes microporous sampler points in the different borehole zones. The groundwater testing well borehole may be formed with a well casing that is afterwards removed while retaining the probe assembly in position.

9 Claims, 2 Drawing Sheets

10

32
42
44
44
42
34
16
24
30
32
44
42
34
14
30
22
12
44
42
28
30
20
32
44
42
26
34
18
44
42
30
44
42

GROUNDWATER TESTING WELL

FIELD OF THE INVENTION

This invention relates generally to groundwater testing wells, and particularly concerns a groundwater testing well that may be utilized advantageously when monitoring contamination site subsurface biological, hydraulic, and geochemical conditions in support of biological remediation programs applicable to the contamination site.

BACKGROUND OF THE INVENTION

In numerous industrial regions throughout the world increased efforts are being undertaken to accomplish biological remediation of earth subsurface contamination in an in situ manner in preference to effecting engineered biodegradation of contaminants in above-ground bioreactors that are located distant from, or even at, the earth contamination site. In instances when an earth subsurface contamination field has been selected for in situ bioremediation, it generally becomes necessary to first obtain considerable parameter information pertaining to existing subsurface contamination conditions at different locations in the field sites and at different site depth zones. This enables one to subsequently analyze the obtained parameter information in order to prescribe and implement a contamination field subsurface bioremediation plan, and to afterwards monitor the effectiveness of that bioremediation plan and its implementation.

Earth subsurface bioremediation program implementation efforts generally involve taking groundwater samples as well as obtaining parameter data at numerous different well locations throughout the contamination field, and at several different groundwater depth zones at each different well location, for subsequent analysis. Also, such groundwater sampling and data acquisition efforts are generally repeated many times throughout the duration of a typical earth subsurface bioremediation program.

We have discovered a construction of a groundwater testing well and probe assembly and methods of groundwater testing well and probe assembly installation that may be utilized advantageously in connection with the implementation of various earth subsurface bioremediation programs and support processes. The instant apparatus and method inventions, when utilized in an applicable bioremediation program, function to facilitate obtaining groundwater samples and groundwater parameter data from different well boreholes and different depth zones of the well boreholes without experiencing the otherwise adverse effects of surface water inflow or infiltration into the many boreholes or interzonal groundwater flow within the borehole.

Importantly, the apparatus also facilitates the development of subsurface soil hydraulic conductivity and hydraulic permeability data pertaining to the contamination site using obtained groundwater electrical conductivity measurements.

Further, the instant inventions also may be practiced to realize important cost reductions in comparison to the costs traditionally associated with conventional groundwater testing wells and their method of installation, especially when related to the bioremediation of an extensive contamination site having numerous groundwater testing wells utilized repeatedly and over prolonged periods of time to effect in situ biological remediation of subsurface soil contamination.

Other advantages and objectives associated with the present invention will become apparent from a careful consideration of the drawings which accompany this specification and of the detailed descriptions and claims which follow.

SUMMARY OF THE INVENTION

The groundwater testing well assembly of the present invention is basically comprised of a vertically-oriented well casing having one or more joined rigid well casing sections, a separate well drive point element removably co-operating with the lowermost extreme of the well casing, and a groundwater probe installed in the well casing and comprised of one or more groundwater probe subassemblies. Each included groundwater probe subassembly is basically comprised of a rigid core stem element, at least one yieldable disc seal element that is carried by the core stem element and that has a planform that is larger than the interior planform of the well casing and preferably at least as large as the exterior planform of the well casing, and a microporous sampler point element located within the planform of the resilient disc seal element. The sampler point element is contained within the well casing subassembly and positioned intermediate the resilient disc seal element and the assembly drive point element upon complete installation of the groundwater probe subassembly in the well casing subassembly.

The sampler point element is preferably comprised of a section of microporous tubing with closed ends and contains the inert metal electrodes of an electrical conductivity cell. Co-operating with the sampler point element are sample lines in the form of insulated electrical circuit leads that are connected to the conductivity cell electrodes and that preferably extend through one closed end of the microporous tubing section and through each encountered disc seal element in route to an surface-located electrical conductivity metering device. Also combined with the sampler point element is a section of riser tube that communicates with the interior of the microporous tubing section and that extends through each included resilient disc seal in route to a surface-located conventional pump device. The pump device and sample line riser tube are used amongst other things to inject an electrolyte solution or deionized water into the microporous sampler point element in connection with determinations of subsurface soil hydraulic conductivity and permeability.

Depending upon earth subsurface bioremediation application requirements, multiple groundwater probe subassemblies may be sequentially combined and co-operably engaged with corresponding multiple sections of well casing. If the well casing is fluid-impervious, the assembly well casing is removed from the well borehole following well installation but the included ground water probe subassemblies are retained in the well borehole with the resilient disc seal elements dividing the well borehole into separate depth zones of particular interest, each with a separate sampler point element. If the well casing is fluid-permeable, the well casing may remain in the well borehole with the resilient disc seals elements dividing the well borehole into the desired separate depth zones of particular interest, each with a separate sampler point element.

Additional details regarding the groundwater testing well apparatus of the present invention and its methods of installation and use are set forth in the drawings and in the detailed descriptions and claims which follow.

DETAILED DESCRIPTION

Figure 1:
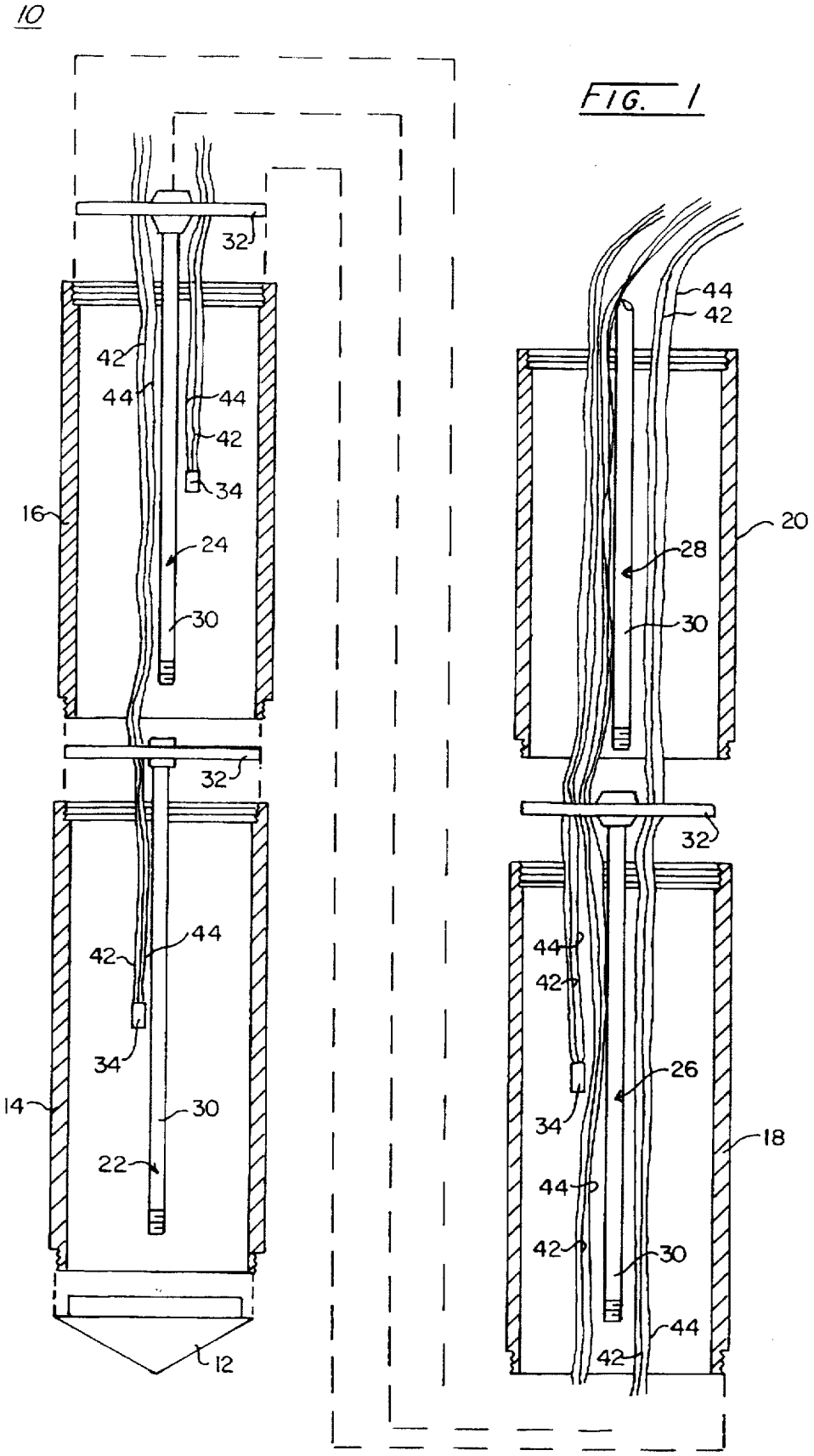
FIG. 1 is a schematic exploded and sectioned elevation view of a preferred embodiment of the well casing and groundwater probe assembly of the present invention.

In FIG. 1 the reference numeral 10 generally designates the principal testing well components that may be assembled and installed at an earth subsurface contamination site to comprise the groundwater testing well of the present invention. Well assembly 10 includes a detachable well drive point 12, interconnected well casing sections 14 through 20, and interconnected probe subassembly sections 22 through 28. Drive point 12 preferably is fabricated of a relatively hard metal or metallic material. Casing sections 14 through 20 have threaded connections at their co-operating section ends to facilitate interconnection, and may be fabricated of an extruded metallic or plastic material depending upon intended application. Assemblies intended for installation in dense or heavy soils such as various clays are normally fabricated of a metallic material. If intended for installation in a less dense and more friable soil such as sand or loam, the well casing sections may be fabricated of a plastic material such as a polyvinyl chloride resin.

Included in assembly 10 for insertion in well casing sections 14 through 20 are interconnected probe assembly sections 22 through 28 which each comprise a subassembly that includes a core stem element 30 and generally at least one microporous sampler point element 34. In most but not all instances at least one yieldable disc seal element 32 is carried by one of said core stem elements 30. Stem element 30 is normally fabricated of a metallic or polymeric material and has threaded connections at its co-operating ends. Resilient disc seal elements 32 may be manufactured from a stiff synthetic rubber sheet stock or other similarly yieldable polymer material, and have a planforms that are larger than the interior cross-sectional planforms of well casing sections 14 through 20 and that preferably are at least slightly larger than the exterior cross-sectional planforms of such well casing sections.

Figure 4:
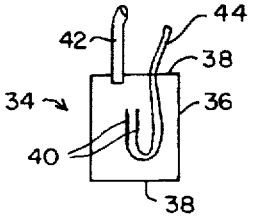
FIG. 4 is a schematic sectioned elevation view of a sampling point element included in the assemblies of FIGS. 1 through 3.

Details regarding novel microporous sampler point elements 34 of assembly 10 are provided in FIG. 4. Each such element is fabricated of a short section 36 (e.g., 0.5 to 1.0 inch length) of small diameter (e.g., 0.25 to 0.5 inch diameter) microporous tubing (e.g., 20 to 200 micron pore size), has adhered end caps 38, and preferably contains a pair of inert metal electrical conductivity electrodes 40. The interior of microporous tubing section 36 communicates with an identified, small diameter riser tube 42 that passes through a tubing section end cap 38 and that serves as the inlet line to a conventional pump device (not illustrated) provided at the contamination site surface. Such pump serves to collect samples of groundwater or gasses that from time to time flow into sampler point element 34 from soils in the soil zone of interest that surrounds the adjacent well casing section. Electrical conductivity electrodes 40 are preferably connected to color-coded insulated electrical circuit lead wires 44 that pass through a tubing section end cap 38 and serve to electrically connect electrodes 40 to a conventional electrical conductivity meter device (not illustrated) that is provided at the contamination site to obtain electrical conductivity data related to groundwater subsurface flow rates.

In assembling probe assembly sections 22 through 28, particular lengths of core stem element 30 and its co-operating resilient disc seal element 32 and microporous sampler point element 34 are selected and joined in sequence so that each subsurface zone or strata of a soil of interest for groundwater collection, etc. has a corresponding well borehole zone that is isolated by a pair of spaced-apart disc seal elements 32 and includes a microporous sampler point element 34. The presence of resilient disc seal elements 32 in the well borehole prevents vertical flow and cross-contamination of groundwaters from and between different adjacent subsurface soil zones of interest.

Figure 2:
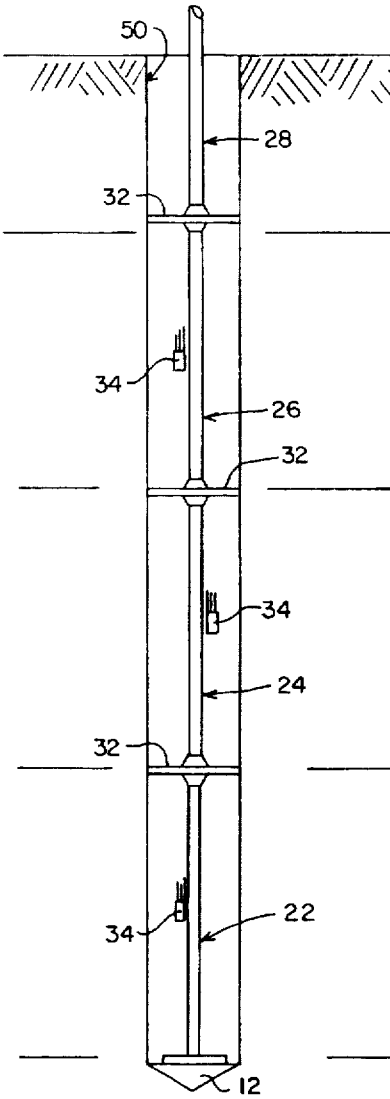
FIG. 2 is an schematic sectioned elevation view illustrating the assembly of FIG. 1 in its installed condition as a groundwater testing well.
Figure 3:
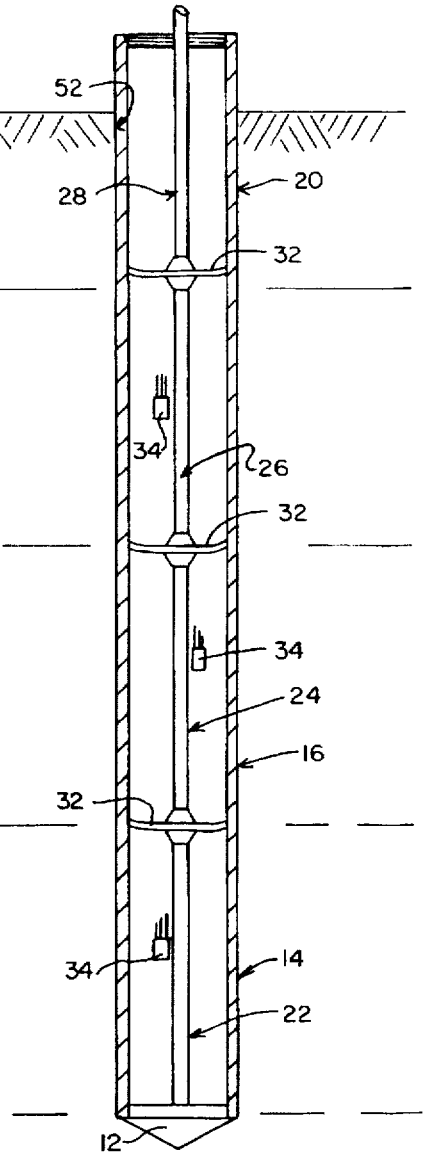
FIG. 3 is similar to FIG. 2 but illustrates an alternate embodiment of the present invention.

FIGS. 2 and 3 illustrate the probe subassemblies 22 through 28 of FIG. 1 in their assembled condition but as installed in two different groundwater testing wells. The FIG. 2 illustration relates to a groundwater testing well installed at a contamination site having a sand-like soil condition which is conducive to well casing removal following probe subassembly installation. FIG. 3 illustrates a groundwater testing well installed at a contamination site having a heavy or clay-like soil condition requiring that the well casing be retained in the well. The FIG. 2 groundwater testing well permits the use of a well casing assembly having fluid-impervious walls; the FIG. 3 groundwater testing well installation has well casing sections with fluid-permeable walls, i.e. with walls that are porous or have openings which permit the flow of groundwater into the casing interior.

In the FIG. 2 arrangement the contamination site is shown as having a groundwater testing well borehole 50 which was formed by driving well drive point 12 and sequentially added well casing sections 14 through 20 manually or with a vibratory hammer device to the position shown. Probe sections 22 through 28 are, following assembly, positioned within the assembled well casing sections in a manner whereby the included resilient disc seal elements 32 essentially divide the borehole into vertical zones that are laterally aligned and correspond to the contamination site subsurface soil zones of interest. Installed well casing sections 14 through 20 are then sequentially removed from borehole 50 in reverse to their order of installation leaving drive point 12 and assembled probe sections 22 through 28 in place. Over time the sand-like subsurface soil surrounding borehole 50 fills the borehole leaving sampler points 34 and their riser tube and insulated circuit conductor elements in place. Until borehole 50 becomes completely filled, disc seal elements 32 prevent the vertical migration of groundwaters between different zones of the borehole thus contributing to more accurate sampling of groundwater at different subsoil strata of interest.

In the FIG. 3 arrangement, the groundwater testing well is installed in a heavy or clay-like soil, and because substantial efforts would be required to effect well casing removal the assembled well casing sections 22 through 28 are retained in place in the resulting borehole 52. As previously indicated, well casing sections 22 through 28 in that application are provided with fluid-permeable walls to permit groundwater in the various sampling zones of interest to flow laterally into the well casing interior. Generally, wall perforations or openings such as elongated slot openings, sometimes provided with a solids-filtering screen, are satisfactory for achieving the fluid permeability characteristic in the well casing sections. We find it advantageous sometimes that the interior of the assembled well casing sections be filled with a packed granular material such as sand as the probe assembly is positioned within well casing interior.

Various changes may be made to the described materials, shapes, and sizes comprising the apparatus and methods of the present invention without departing from the meaning or intent of the claims appended hereto.

We claim our invention as follows:

1. A groundwater testing well for analytically sampling groundwaters from a well borehole surrounded by different subsurface soil zones of interest, and comprising:

a well drive point;

a tubular well casing contacting said well drive point and extending upwardly the length of the well borehole;

a rigid probe assembly stem supported by said well drive point and extending the length of said tubular well casing;

flexible seal elements mounted on said probe assembly;

microporous sampler points positioned within said tubular well casing and intermediate said flexible seal elements to receive groundwaters; and sample lines connected to said microporous sampler points and extending through openings in said multiple flexible seal elements and to above said tubular well casing, said combined probe assembly stem, flexible seal elements, microporous sampler points, and sample lines being slidably positioned within said tubular well casing with said flexible seal elements being located at approximately the lines of demarcation between the different subsurface soil zones of interest.

2. The groundwater testing well defined by claim 1 wherein said flexible seal elements have planforms that correspond to but are greater in size than the interior cross-sectional planform of said tubular well casing.

3. The groundwater testing well defined by claim 1 wherein said microporous sampler points have walls with pores in the range of from 20 microns to 200 microns in size.

4. The groundwater testing well defined by claim 1 wherein said microporous sampler points contain within their interiors fluid riser line inlets and pairs of inert metal electrodes for measuring the electrical conductivity of groundwater flowed into said sampler points from adjacent subsurface soil zones of interest.

5. The groundwater testing well defined by claim 1 wherein said tubular well casing has fluid-permeable walls and is filled with a granular medium in its interior and in surrounding relation to said microporous sampler points and said flexible seal elements.

6. A groundwater sampling probe assembly for installation in a tubular well casing adapted to be withdrawn from an in ground well bore and comprising:

a well drive point;

a rigid stem;

flexible disc seals mounted on said rigid stem;

multiple microporous hollow sampler point elements positioned adjacent said rigid stem and intermediate said flexible disc seals;

multiple sample lines connected to said microporous sampler point elements and passing through said flexible disc seals adjacent said rigid stem; and wherein said microporous hollow sampler point elements are exposed directly to the around defining the well bore when said casing is withdrawn from said well bore.

7. The invention defined by claim 6 wherein said flexible disc seals each have a planform that is at least as large as the interior cross-sectional planform of the tubular well casing.

8. The invention defined by claim 6 wherein said multiple sample lines include fluid-conducting tube riser lines which flow electrolyte solution into the hollow interiors of said multiple sampler point elements, and a pairs of insulated, electrical conductivity metering circuit leads which are connected to pairs of inert metal electrodes contained within the hollow interiors of said multiple sampler point elements.

9. In a method of installing a groundwater testing well at an earth contamination site having subsurface soil strata of interest, the steps of:

driving tubular well casing and a co-operating well drive point from the earth contamination site surface through the subsurface soil strata of interest;

inserting a probe assembly comprised of a rigid stem, spaced-apart flexible disc seals carried by the stem, and microporous sampler points positioned intermediate the disc seals into the tubular well casing and into contact with the well drive point; and removing the tubular well casing from within the well borehole while retaining said well drive point and said probe assembly in position, said probe assembly flexible disc seals having planforms which are at least as large as the interior cross-sectional planforms of said tubular well casing, and said probe assembly flexible disc seals being positioned on said rigid stem and defining borehole zones which contain said microporous sampler points and correspond to the subsurface soil strata of interest.

* * * * *